US007942549B2

(12) United States Patent
Li

(10) Patent No.: US 7,942,549 B2
(45) Date of Patent: May 17, 2011

(54) LED LAMP HAVING LIGHT GUIDING HEAT SINK

(76) Inventor: Chia-Mao Li, Taipei (TW)

( * ) Notice: Subject to any disclaimer, the term of this patent is extended or adjusted under 35 U.S.C. 154(b) by 88 days.

(21) Appl. No.: 12/253,237

(22) Filed: Oct. 16, 2008

(65) Prior Publication Data

US 2010/0097810 A1 Apr. 22, 2010

(51) Int. Cl.
*F21S 4/00* (2006.01)
*F21V 29/00* (2006.01)

(52) U.S. Cl. ..... 362/249.02; 362/294; 362/373; 362/547

(58) Field of Classification Search ..... 362/545, 362/547, 249.02, 241, 247, 294, 373; 257/88, 257/98

See application file for complete search history.

(56) References Cited

U.S. PATENT DOCUMENTS

| | | | | |
|---|---|---|---|---|
| 4,271,408 | A * | 6/1981 | Teshima et al. | 345/83 |
| 5,580,156 | A * | 12/1996 | Suzuki et al. | 362/184 |
| 5,934,798 | A * | 8/1999 | Roller et al. | 362/497 |
| 7,654,691 | B2 * | 2/2010 | Liu et al. | 362/249.02 |
| 7,677,768 | B2 * | 3/2010 | Huang et al. | 362/294 |
| 2003/0156416 | A1 * | 8/2003 | Stopa et al. | 362/294 |
| 2008/0080189 | A1 * | 4/2008 | Wang | 362/294 |
| 2010/0038657 | A1 * | 2/2010 | Higuchi et al. | 257/88 |

FOREIGN PATENT DOCUMENTS

TW M289519 4/2006

* cited by examiner

*Primary Examiner* — Ismael Negron

(57) ABSTRACT

An LED lamp structure includes a reflection cup, a metal heat sink for receiving a plurality of LEDs, and a heat conducting base. The heat conducting base has a slot for receiving the metal heat sink. The metal heat sink includes guiding planes for redirecting the output of an LED so as to change the angle of projected light. The metal heat sink is made of a good heat conductor with high thermal capacity so that heat produced by the LED is absorbed quickly and conducted to the heat conducting base. The reflection cup is flexed to an outer edge of the metal heat sink to provide a flat lighting characteristic.

3 Claims, 5 Drawing Sheets

LED LAMP HAVING LIGHT GUIDING HEAT SINK

FIELD OF THE PRESENT INVENTION

The present invention relates to encapsulation, and particular to an LED lamp structure having a metal heat sink being arranged by guiding planes for receiving LEDs so as to change the angle of light and increase optical efficiency. The metal heat sink is a good heat conductor with high thermal capacity so that heat on LED chips is absorbed quickly and being conducted to a heat conducting base through a large surface thereof. Heat generated from the LED chips of the metal heat sink is dissipated quickly so that temperatures of the LED chips are substantially lowered;

DESCRIPTION OF THE PRIOR ART

Light emitting diode (LED) has advantages of power saving, small size, capability of emitting light in different colors, and environment-friendly. It is well applied on cell phones, automobiles, back light for medium and small size panels, traffic lights, and further into illumination field. Recently, LED illumination for outdoors is extensively developed so as to take the place of traditional illumination. However, high power LED has a thermal problem. The higher the power of the LED is, more heat is generated, and the LED keeps higher temperature. While the temperature of an LED chip goes higher, the light output efficiency is lowered and the life time of the LED chip is shortened. Thus, a good lamp body structure with well heat dissipation ability, suitable for a flat lighting characteristic of a LED, capable of changing angle of light, raising optical efficiency is an important subject to develop.

On the other hand, the prior illuminating device is also improved about heat dissipation such as the Taiwan patent no. M289519 about an ultra high efficiency package structure. According to the patent, a single or multiple LED chips are installed on a carrying surface of a metal heat sink of well thermal conductibility, and the metal heat sink is sat on a heat conducting base through a heat conducting and electrical insulating layer. Three components are combined so as to dissipate heat on the LED chips quickly. However, an LED array arrangement will have the lights been blocked and absorbed by the LED chips so that the lighting efficiency will be lowered. While the quantity of the LED chips or the power of the LED chip is higher, temperature of certain part of LED chips goes too high. Accordingly, a good and simple structure to solve the thermal problem is provided in the following. With guiding planes added to the metal heat sink, a structure of the guiding planes enlarges the heat dissipation area so that heat on the LED chips are dissipated and temperature of the metal heat sink will not become too high. In the same time, the guiding planes can change projecting angle of lights so as to raise optical efficiency. With a surface area added by the metal heat sink, heat on the LED chips of the metal heat sink is absorbed quickly and being conducted to the heat conducting base so that heat on the LED chips of the metal heat sink is dissipated quickly and temperatures of the LED chips are substantially lowered. The comprehensive heat dissipating effect can extend a lifetime of the LED and it is also the technical point that the inventor of the present invention want to solve.

SUMMARY OF THE PRESENT INVENTION

To achieve above objects, an LED lamp structure according to the present invention includes a reflection cup, a metal heat sink, and a heat conducting base. The heat conducting base has a recess for receiving the metal heat sink. The metal heat sink is formed with guiding planes which are suitable for receiving LEDs so as to change the angle of lights and increase optical efficiency. The metal heat sink is a good heat conductor with high thermal capacity so that heat on a LED chip is absorbed quickly and being conducted to the heat conducting base through a larger surface thereof. Heat generated from the LED chips of the metal heat sink is dissipated quickly so that temperatures of the LED chips are substantially lowered. The reflection cup suitable for the flat LED is fixed to an outer edge of the metal heat sink. The reflection cup has a reflecting curved surface on an inner wall thereof. By the different reflecting curvatures of the reflection cup, different light projection distributions are formed.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
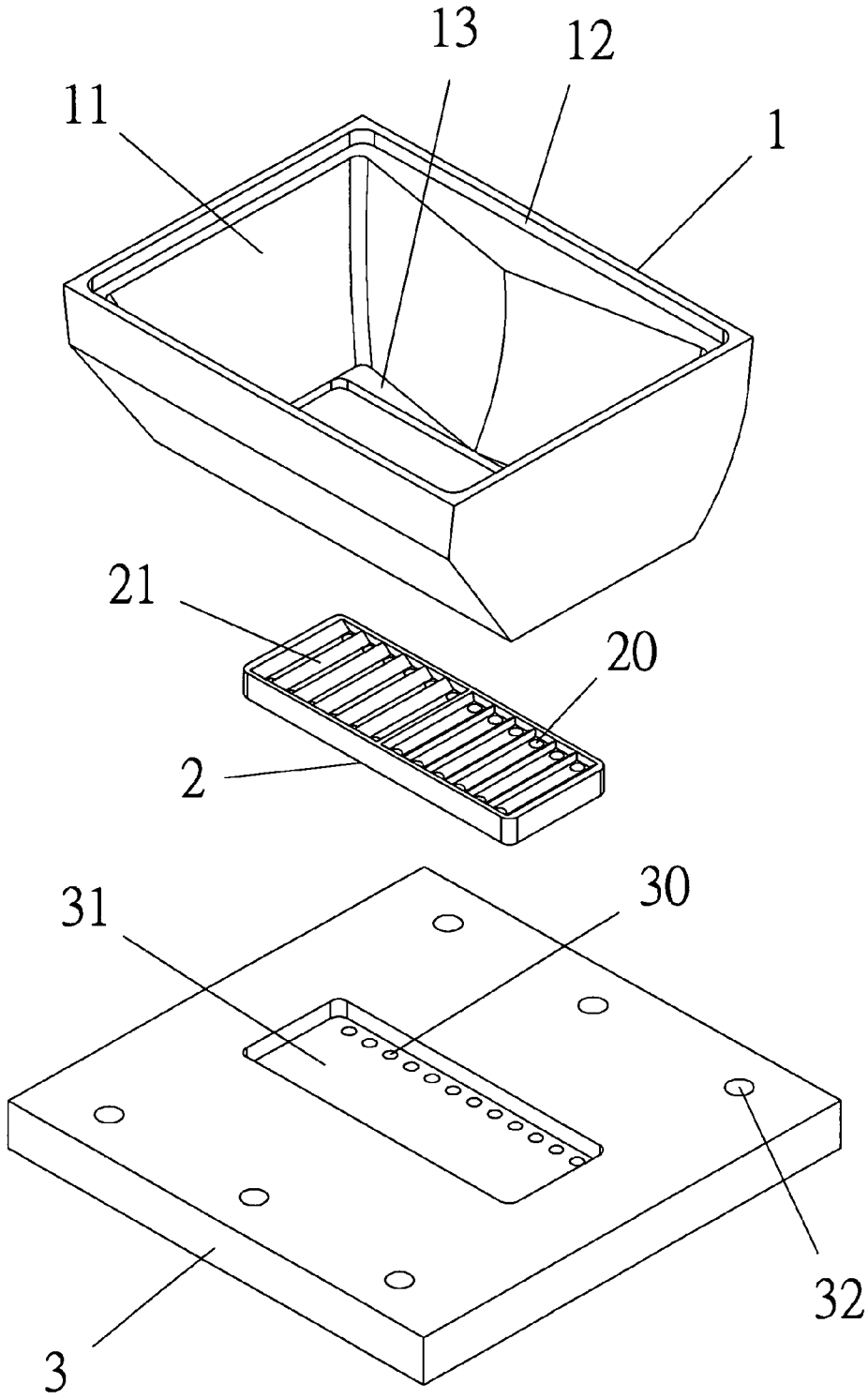
FIG. 1 is an exploded view of the present invention.
Figure 2:
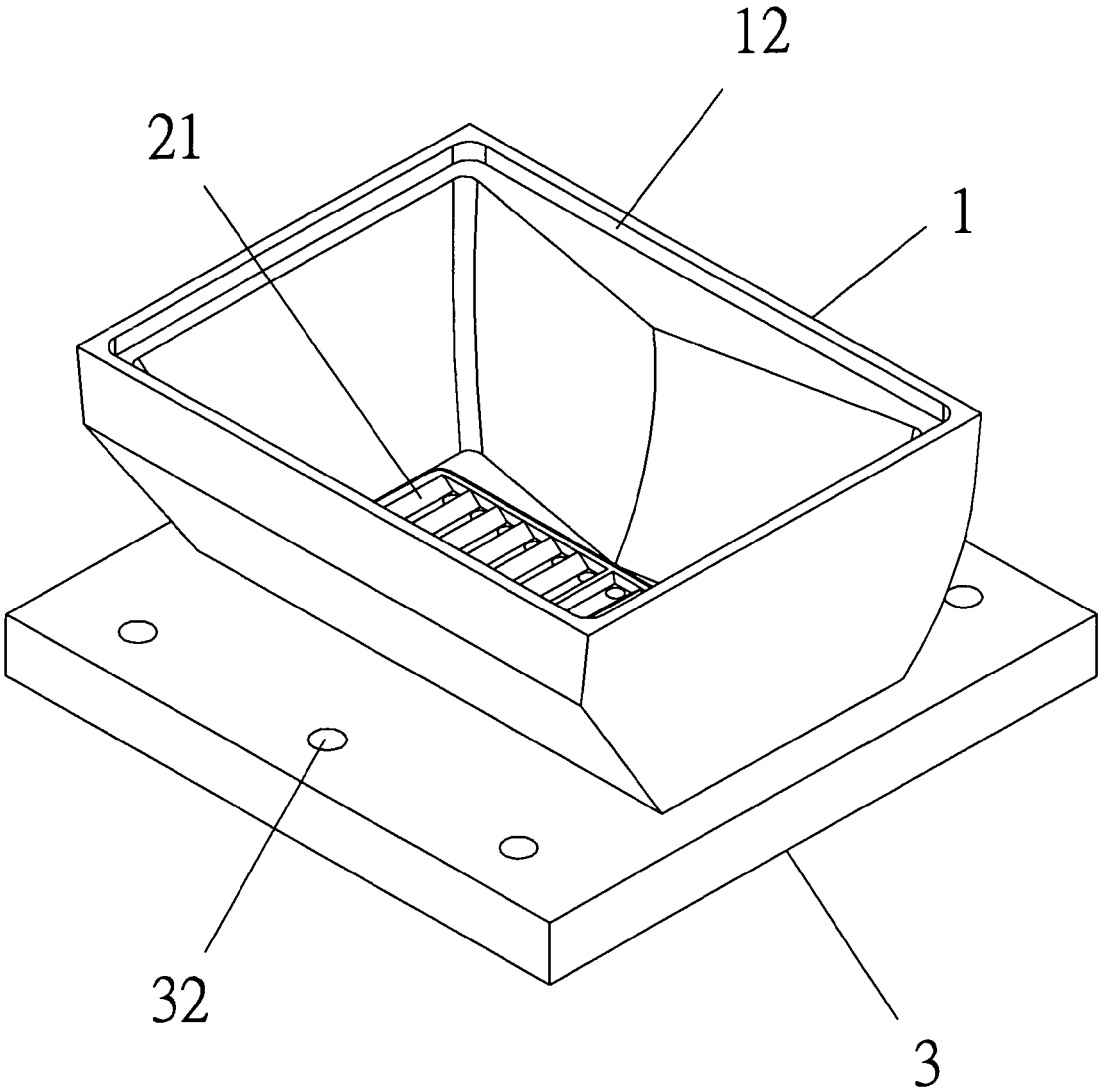
FIG. 2 is an assembly view of the present invention.

Referring to FIGS. 1 and 2, an LED lamp structure according to the present invention includes a reflection cup 1, a metal heat sink 2, and a heat conducting base 3. The heat conducting base 3 has a recess 31 and through holes 32 on a bottom side of the recess 31. The metal heat sink 2 inserts into the recess 3 to be fixed therein. A plurality of bolts are screwed into the through holes 32 for retaining a lighting device. The slot 31 further has through holes 30 formed inside thereof. The metal heat sink 2 is formed with a plurality of guiding planes 21 which are suitable for a flat lighting characteristic of an LED so as to change the angle of light and increase optical efficiency. The metal heat sink 2 is a good heat conductor and has higher thermal capacity so that heat generated from LED chips is absorbed quickly and being conducted to the heat conducting base 3 through a large surface thereof. Heat on the LED chips of the metal heat sink 2 is dissipated quickly so that temperatures of the LED chips are substantially lowered. The reflection cup 1 suitable for the flat lighting characteristic of LED is fixed to an outer edge of the metal heat sink 2. The reflection cup 1 is a hollow body with two openings and a reflecting curved surface 11 is formed on an inner wall. A concave edge 12 is formed to an opening of the reflection cup 1 and a joint 13 is formed to another opening of the reflecting cup 1 for connecting with an outer edge of the metal heat sink 2. By the different reflecting curvatures of the reflection cup 1, different light projecting distributions are formed.

Figure 3:
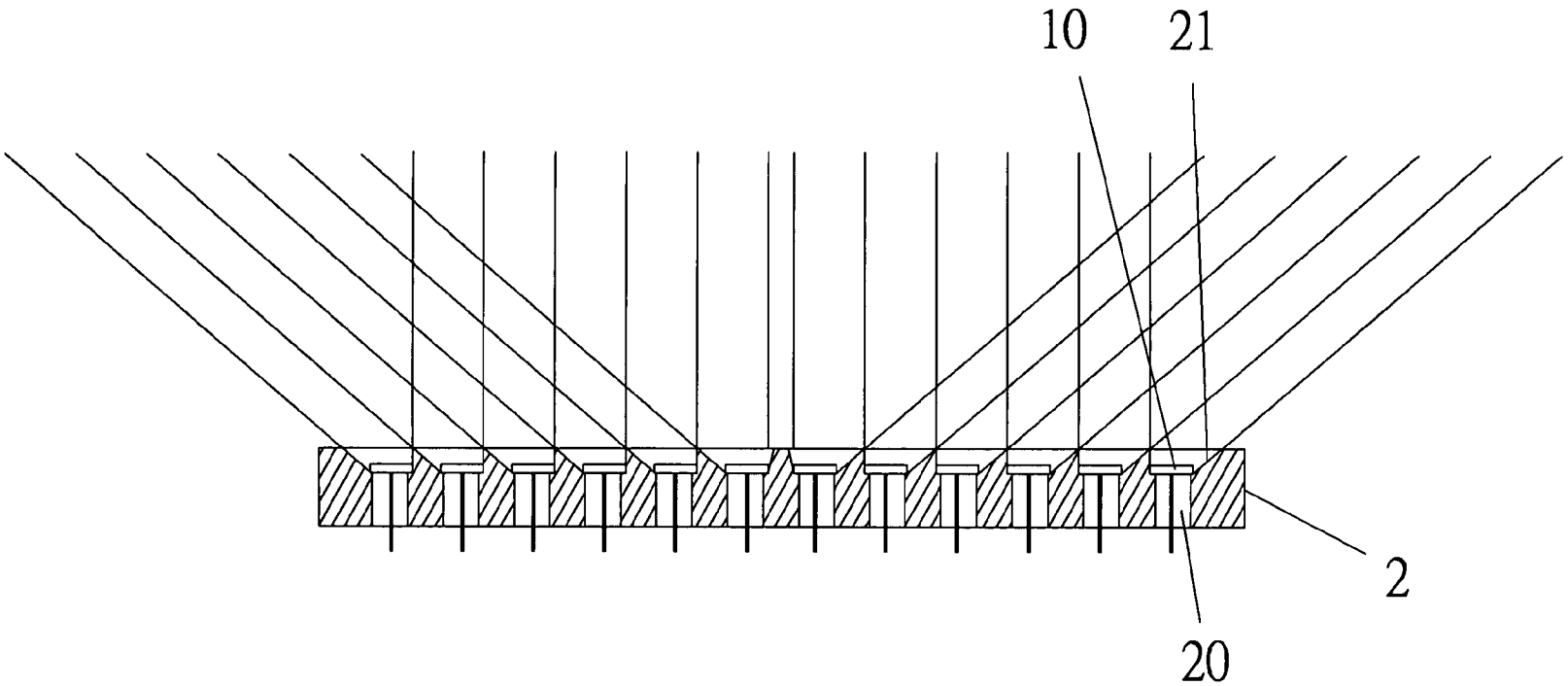
FIG. 3 is a schematic view showing an embodiment of a metal heat sink of the present invention.
Figure 5:
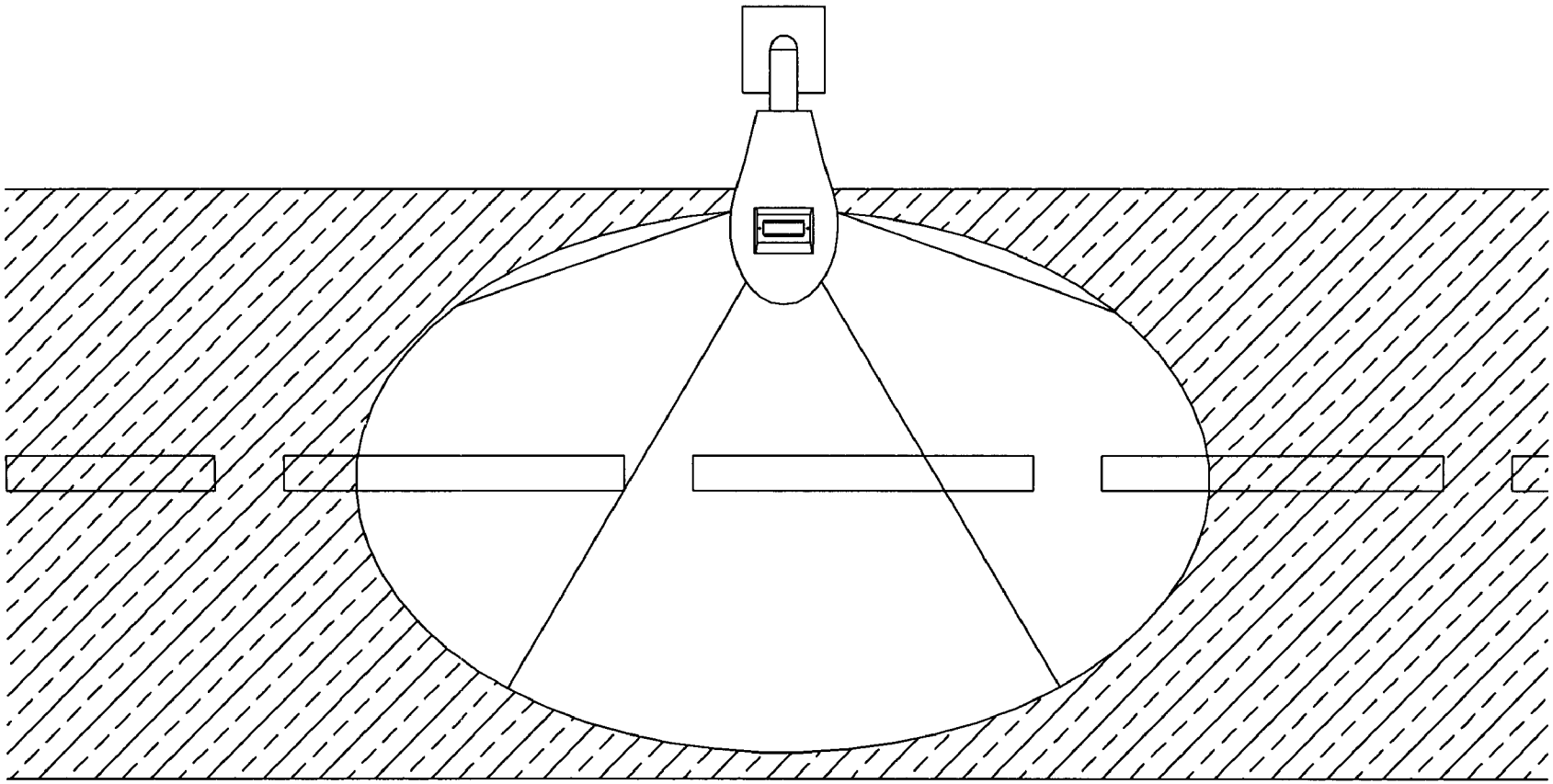
FIG. 5 is a schematic view of an embodiment of the present invention.

With reference to FIGS. 3 and 5, through holes 20 are formed in to the metal heat sink 2 for arranging the pins of the LED chips 10. A plurality of guiding planes 21 are formed on a surface of the metal heat sink 2 by stamping beside the through holes 20. The plurality of guiding planes 21 having large inclined planes on a right side of the through holes 20 are formed on a right half surface of the metal heat sink 2, while guiding planes 21 with inclined plane on a left side of the through holes 20 are formed on a left surface of the metal heat sink 2. Lights emitted from the LED chips 10 will be guided to the right side and left side by the guiding planes 21 and through the reflecting curved surface 11 of the reflection cup 1, lights will be projected uniformly on both right and left sides.

Figure 4:
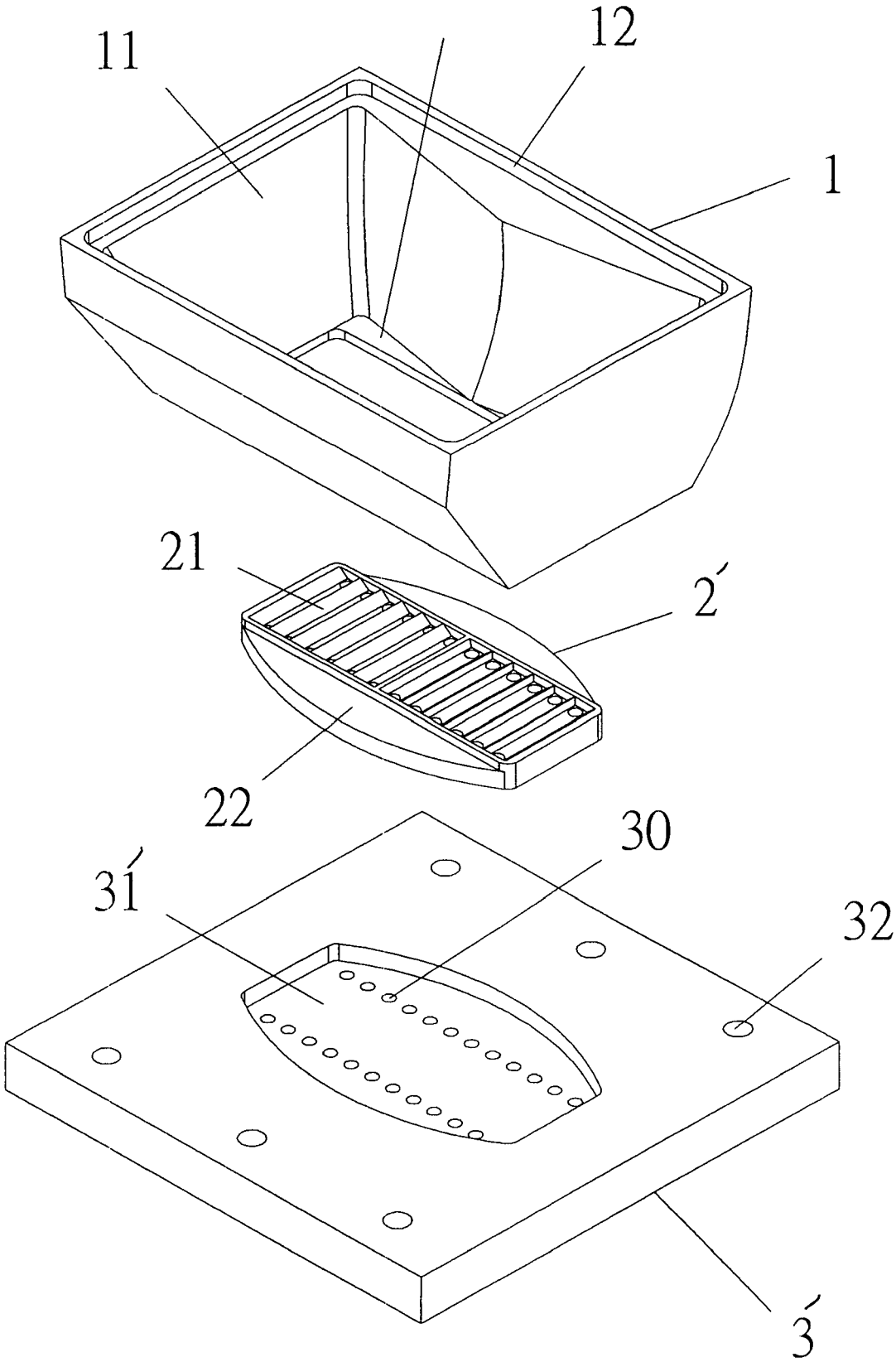
FIG. 4 is an exploded view of another preferable embodiment of the present invention.

Referring to FIG. 4, another preferable embodiment of the present invention is illustrated. To have a higher efficiency of heat dissipation, a heat dissipating area of the metal heat sink 2' is enlarged. Wing sheets 22 are added for enlarging the contact area between the metal heat sink 2' and the heat conducting base 3' having a recess 31' so that heat on high power LED chips are absorbed and are conducted to the heat conducting base 3' more quickly. Heat generated from the LED chips of the metal heat sink 2' is dissipated quickly so that temperatures of the LED chips are substantially lowered.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An LED lamp structure comprising:

a flat LED lamp;

a reflection cup coupled to the flat LED lamp and having a light reflecting curved inside surface;

a metal heat sink coupled to an outer edge of the reflection cup, the metal heat sink including a plurality of guiding planes configured to change the angle of lights emitted by the LED lamp, the metal heat sink being a rectangular frame and each of the guiding plane is a transversal long straight sheet, and the at least some of the plurality of guiding planes are arranged to be approximately parallel;

pin holes formed in the metal heat sink for accommodating pins of the LED lamp;

a heat conducting base having a recess for receiving the metal heat sink, wherein the metal heat sink has a high thermal capacity to quickly absorb and conduct the heat produced by the LED lamp to the heat conducting base reduce the temperature of the LED lamp, wherein a plurality of through holes are formed in the recess, the metal heat sink being inserted into the recess to be fixed therein; and a plurality of bolts screwed into the through holes for attachment to a lighting device.

2. The LED lamp structure as claimed in claim 1, wherein the guiding planes comprising pair of inclined planes formed on a surface of the metal heat sink on both sides of each corresponding pin holes; each pair of inclined planes having a larger inclined planes on one side of the corresponding pin holes, and a smaller inclined plane on the other side of the corresponding pin hole; wherein the arrangement of the pair of inclined planes of the pin holes are symmetrical about a center axis of the metal heat sink.

3. The LED lamp structure as claimed in claim 1, wherein the metal heat sink further has wing sheets formed at two parallel sides of the metal heat sink and each wing sheet has a convex cambered outer side.

* * * * *